US007234962B1

(12) United States Patent
Lin

(10) Patent No.: US 7,234,962 B1
(45) Date of Patent: Jun. 26, 2007

(54) WIRE CONNECTING TERMINAL STRUCTURE

(76) Inventor: Kuei-Yang Lin, 7th Floor, No. 90, Song Qin Street, Sinyi District, Taipei City (TW)

( * ) Notice: Subject to any disclaimer, the term of this patent is extended or adjusted under 35 U.S.C. 154(b) by 0 days.

(21) Appl. No.: 11/442,361

(22) Filed: May 30, 2006

(51) Int. Cl.
*H01R 4/24* (2006.01)

(52) U.S. Cl. ..... 439/441; 439/656

(58) Field of Classification Search ..... 439/441, 439/439, 440, 656, 725, 727, 404, 417
See application file for complete search history.

(56) References Cited

U.S. PATENT DOCUMENTS 3,848,951 A * 11/1974 Michaels et al. ..... 439/357
3,963,319 A * 6/1976 Schumacher et al. ..... 439/439
3,994,554 A * 11/1976 Navarro ..... 439/406
4,083,615 A * 4/1978 Volinskie ..... 439/402
4,202,595 A * 5/1980 Inouye et al. ..... 439/493
4,475,786 A * 10/1984 Root et al. ..... 439/404
5,076,801 A * 12/1991 Schroll ..... 439/404
5,174,784 A * 12/1992 Penning ..... 439/439
5,292,260 A * 3/1994 Sinisi et al. ..... 439/441
5,498,172 A * 3/1996 Noda ..... 439/404
5,718,601 A * 2/1998 Masters et al. ..... 439/441
6,328,592 B1 * 12/2001 Burke et al. ..... 439/417
6,716,056 B1 * 4/2004 Hsu ..... 439/417

* cited by examiner

*Primary Examiner*—Tulsidas C. Patel
*Assistant Examiner*—Vladimir Imas
(74) *Attorney, Agent, or Firm*—Rosenberg, Klein & Lee

(57) ABSTRACT

An improved wire connecting terminal structure extensively used in different electric appliances and equipments includes a wire connecting terminal in an input/output interface of the structure. The wire connecting terminal includes a plurality of metal contact brackets coupled with a plastic body by a plastic injection molding. The plastic body includes a two-sectional latch groove disposed on both left and right sides of the plastic body, so that a latch hook disposed on both left and right sides of the latching member is latched into an upper groove of the two-sectional latch groove, and a flexible multi-core cable is passed onto a metal contact bracket, and then the latching member is pressed and latched downward to latch the latch hook into a lower groove of the two-sectional latch groove, so as to closely contact the connecting wire with the metal contact bracket and constitute an overall wire connecting terminal.

3 Claims, 6 Drawing Sheets

WIRE CONNECTING TERMINAL STRUCTURE

BACKGROUND OF THE INVENTION

1. Field of the Invention

The present invention relates to an improved wire connecting terminal structure, and more particularly to a wire connecting terminal extensively used in various different electric appliances and equipments and the wire connecting terminal in an input/output interface includes a plurality of metal contact brackets integrally formed with a plastic body by plastic injection molding and a two-sectional latch groove disposed separately on both left and right sides of the plastic body, such that a latch hook disposed on both left and right sides of the latching member is latched into an upper groove of a two-sectional latch groove first, and a flexible multi-core cable is passed onto a metal contact bracket, and then the latching member is pressed and latched downward, such that the latch hook is latched into a lower groove of the two-sectional latch groove to keep the connecting wire in a close contact with the metal contact bracket and constitute an overall wire connecting terminal.

2. Description of the Related Art

Referring to FIG. 1 for a traditional wire connecting terminal, the wire connecting terminal comprises a plurality of metal contact plates 11 integrally formed with a plastic body 10 by plastic injection molding. Since the present electric appliances and equipments tend to come with a light, small and compact design, therefore the overall dimensions of the wire connecting terminal corresponding to the present electric appliances and equipments are also limited. The interval between adjacent metal contact plates 11 is very narrow, and thus the traditional wire connecting terminal is usually made by soldering a plurality of multi-core wires with a plurality of metal contact plates 11.

The width for soldering the plurality of metal contact plates 11 with the plurality of multi-core cables 12 is very small, and thus causing tremendous difficulties for the soldering operation. Further, it requires a high level of complexity for identifying and soldering many small soft contact wires in a very limited overall area and often causes an overflow of excessive solders from the solder points towards the adjacent metal contact plates 11, or short the circuit and result in a high defective rate and naturally increase the manufacturing or production cost.

To overcome the existing shortcomings of the traditional products and make their applications more convenient and practical, the inventor of the present invention based on years of professional manufacturing experience in the related industry to conduct extensive researches and developments, and finally invented an improved wire connecting terminal structure in accordance with the present invention.

SUMMARY OF THE INVENTION

The primary objective of the present invention is to provide an improved wire connecting terminal structure extensively used in different electric appliances and equipments that includes a wire connecting terminal in an input/output interface of the structure. The wire connecting terminal includes a plurality of metal contact brackets formed with a plastic body by plastic injection molding. The plastic body includes a two-sectional latch groove disposed on both left and right sides of the plastic body, so that a latch hook disposed on both left and right sides of the latching member is latched into an upper groove of the two-sectional latch groove, and a flexible multi-core cable is passed onto a metal contact bracket, and then the latching member is pressed and latched downward to latch the latch hook into a lower groove of the two-sectional latch groove, so as to closely contact the connecting wire with the metal contact bracket and constitute an overall wire connecting terminal and avoid the difficulty of soldering the contact wires to expedite the manufacturing process.

Another objective of the present invention is to make use of the close contact of the wire connecting terminal of the metal contact bracket with the contact wire to enhance the contact effect, the contact stability and the quality of signal transmissions.

DETAILED DESCRIPTION OF THE PREFERRED EMBODIMENTS

The above and other objects, features and advantages of the present invention will become apparent from the following detailed description taken with the accompanying drawing.

Figure 1:
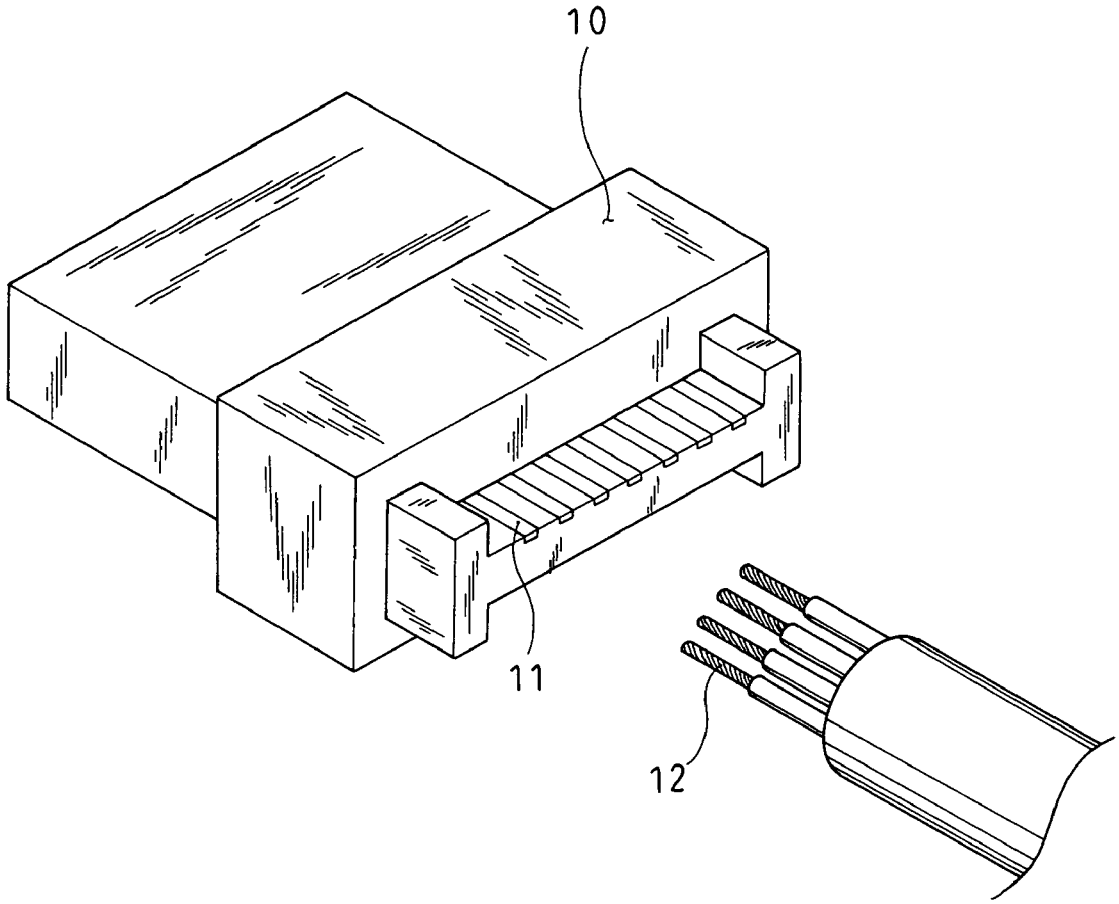
FIG. 1 (PRIOR ART)
FIG. 1 is a schematic view of a traditional wire connecting terminal structure.
Figure 2:
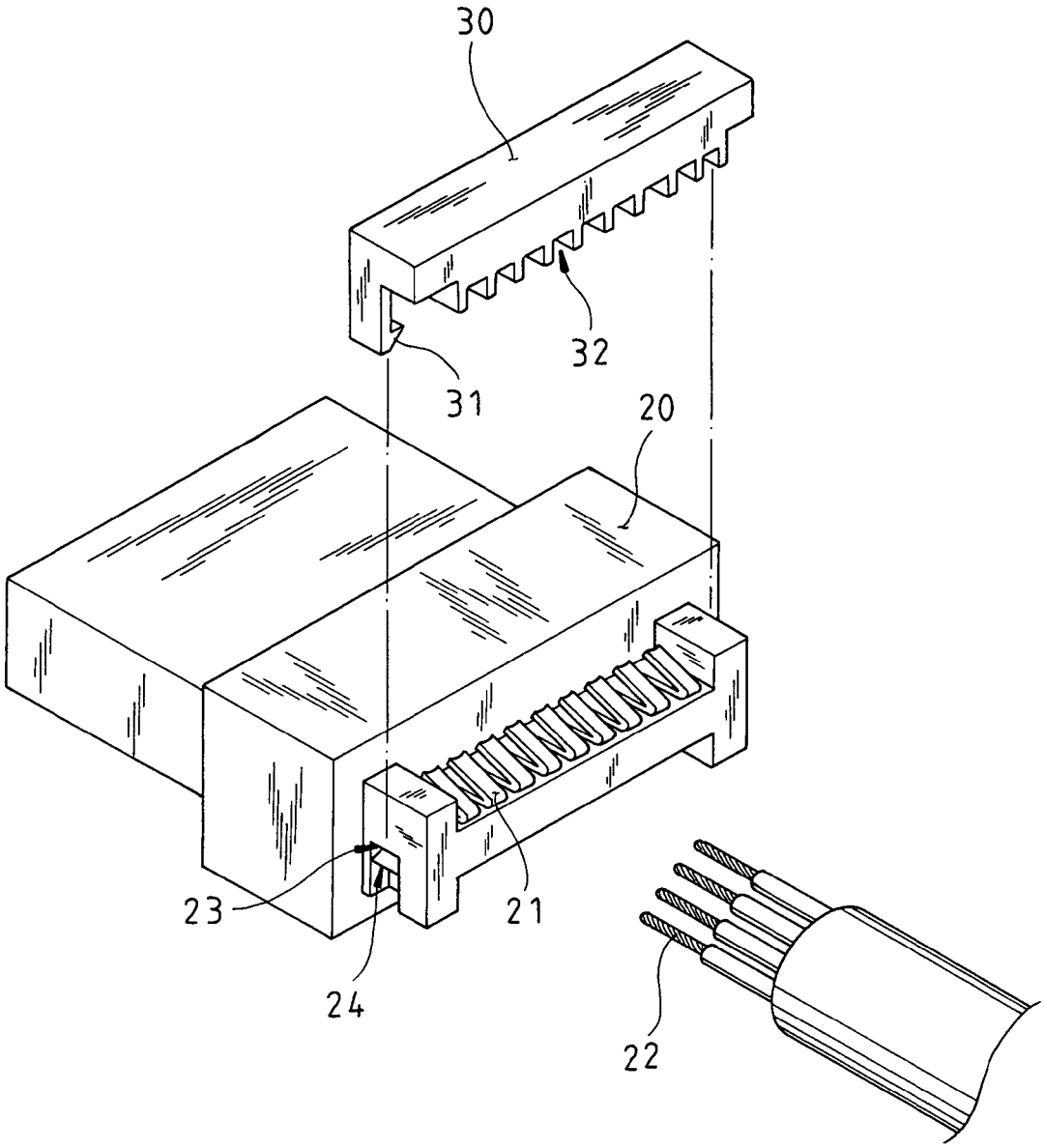
FIG. 2 is an exploded view of the present invention.
Figure 3:
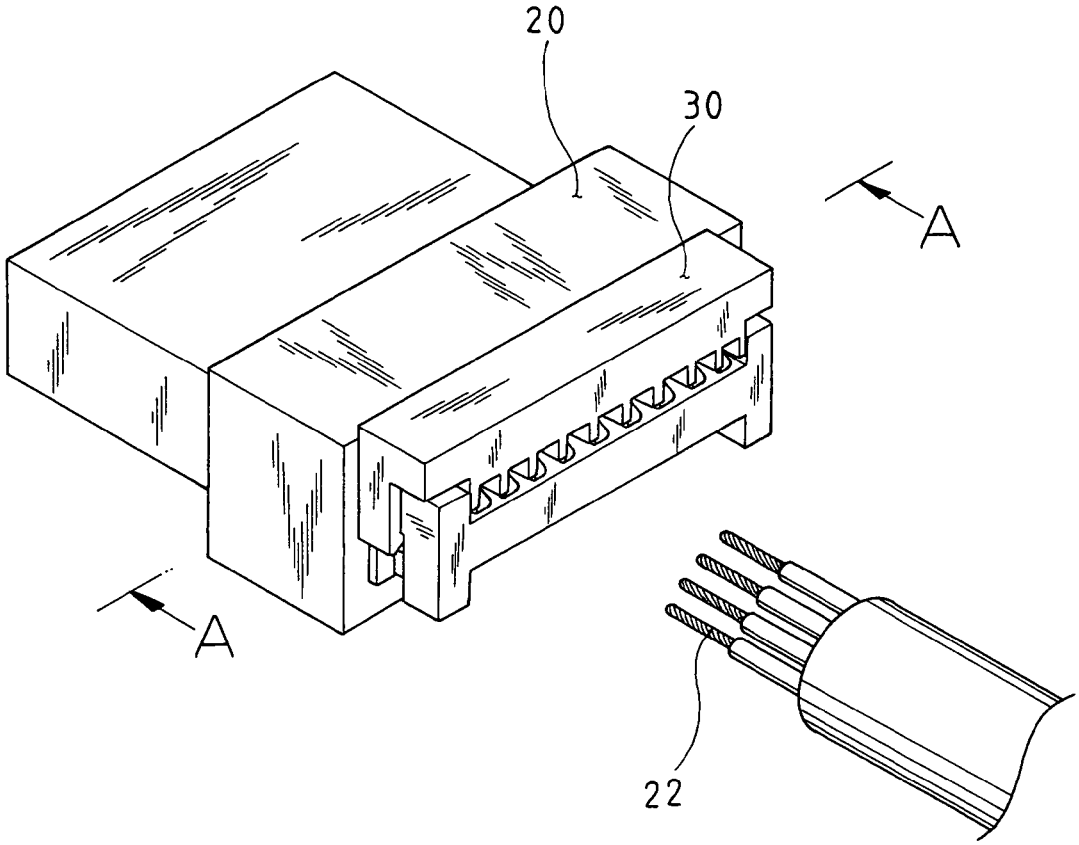
FIG. 3 is a schematic view of the structure of the present invention.

Referring to FIGS. 2 and 3, an improved wire connecting terminal structure comprises a plastic body 20, a metal contact bracket 21, a latching member 30 and a multi-core cable 22.

The plurality of metal contact brackets 21 are evenly arranged on and integrally formed with the plastic body 20 by plastic injection molding, and an end of the plurality of metal contact brackets 21 is exposed from the rear portion of the plastic body 20, and the plastic body 20 includes a two-sectional latch groove having an upper groove 23 and a lower groove 24 disposed separately on both left and right sides of the plastic body 20.

The latching member 30 includes a latch hook 31 disposed on both left and right sides of the latching member 30 and a plurality of containing grooves 32 corresponding to the plurality of metal contact brackets 21.

Figure 4:
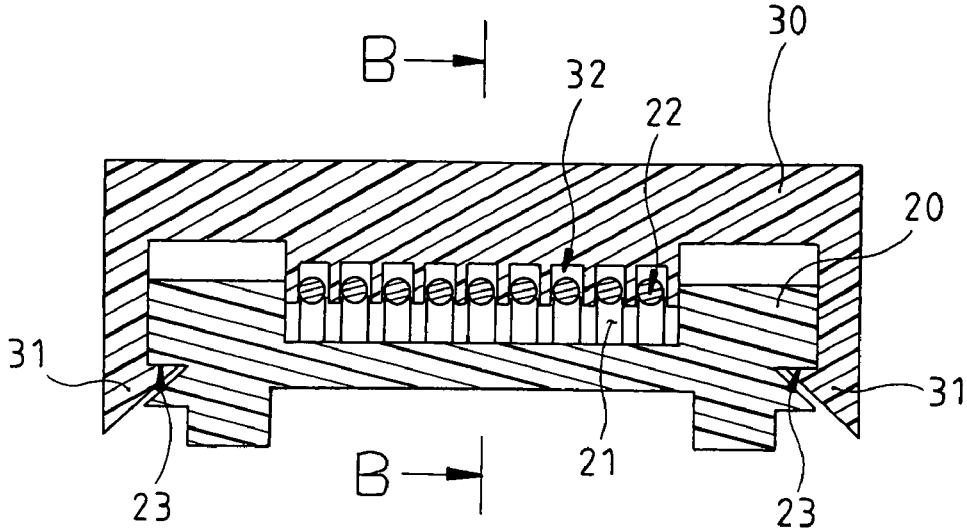
FIG. 4 is a cross-sectional view of Section A-A as depicted in FIG. 3 being latched for the first time.
Figure 5:
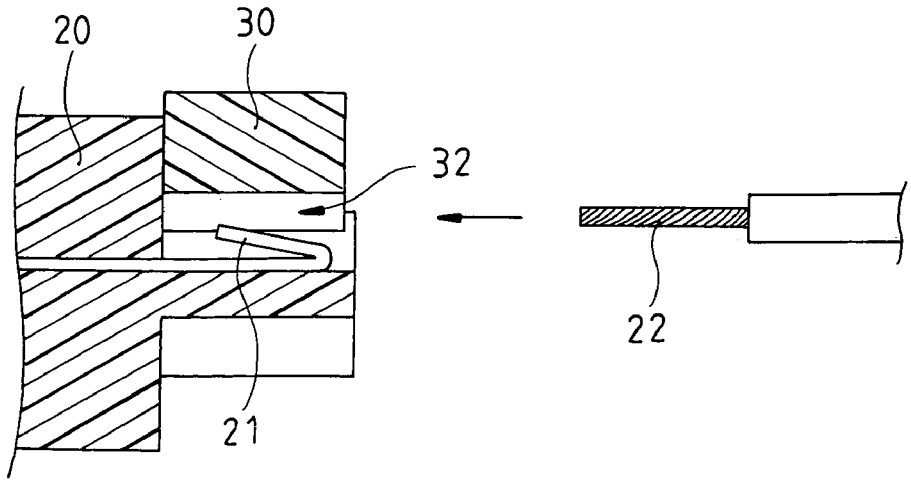
FIG. 5 is a cross-sectional view of Section B-B as depicted in FIG. 4.
Figure 6:
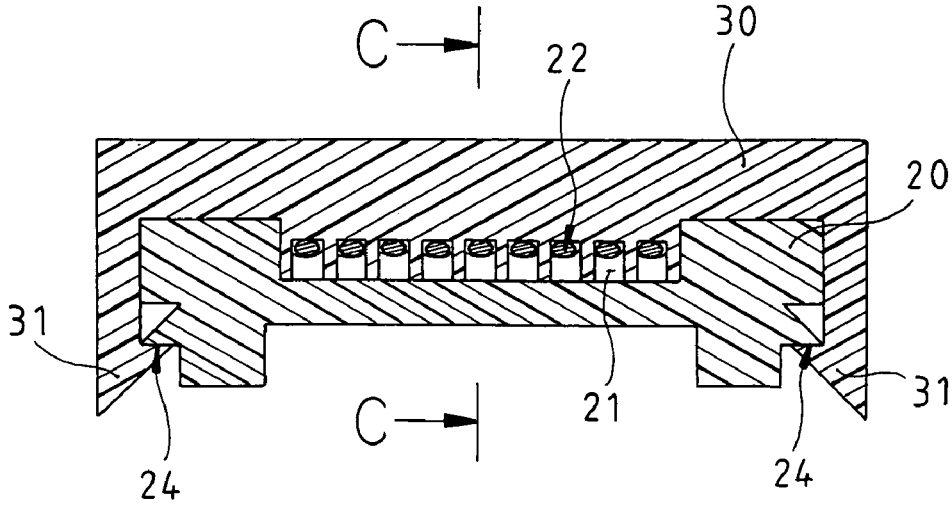
FIG. 6 is a cross-sectional view of Section A-A as depicted in FIG. 3 being latched for the second time.
Figure 7:
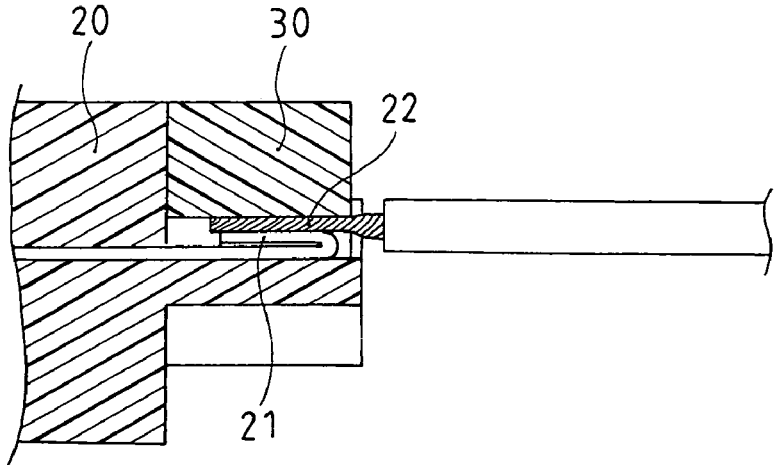
FIG. 7 is a cross-sectional view of Section C-C as depicted in FIG. 6.

The latch hook 31 disposed on both left and right sides of the latching member 30 is latched into the upper groove 23 disposed on both left and right sides of the plastic body 20. Referring to FIGS. 4 and 5, the plurality of containing grooves 32 of the latching member 30 can separate the plurality of metal contact brackets 21 one by one, and a flexible multi-core cable 22 is passed onto the metal contact bracket 21 in the containing groove 32, and the latching member 30 is pressed and latched downward for the second time. Referring to FIGS. 6 and 7, the latch hook 31 disposed on the left and right sides of the latching member 30 is latched into the lower groove 24 disposed on the left and right sides of the plastic body 20 to closely contact the multi-core cable 22 with the metal contact bracket 21 and constitute an overall wire connecting terminal.

In the foregoing improved structure of the present invention, the plastic body 20 includes a two-sectional latch groove with an upper groove 23 and a lower groove 24 disposed on both left and right sides of the plastic body 20 to latch the latch hook 31 of the latching member 30 into the upper groove 23 for the first time, and a flexible multi-core cable 22 can be quickly and precisely passed into the containing groove 32 of the latching member 30, and the latch hook 31 of the latching member 30 is pressed down to latch the lower groove 24 for the second time, so as to form a quick and precise latching structure.

Referring to FIG. 5 for the metal contact bracket 21 of the present invention, the metal contact bracket 21 has an end substantially in the shape of ">" and slightly bent upward with an angle of inclination.

Figure 8:
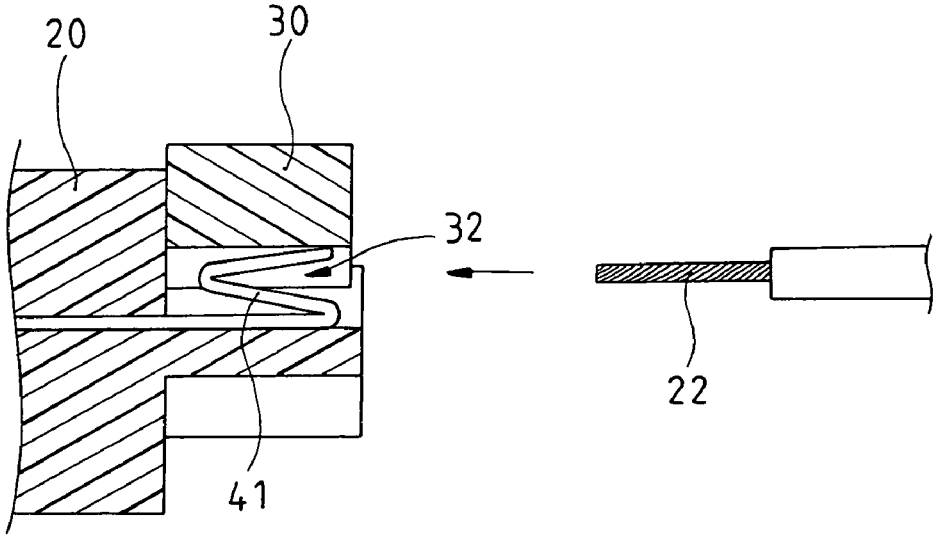
FIGS. 8 and 9 are schematic views of another metal contact bracket according a preferred embodiment of the present invention.
Figure 9:
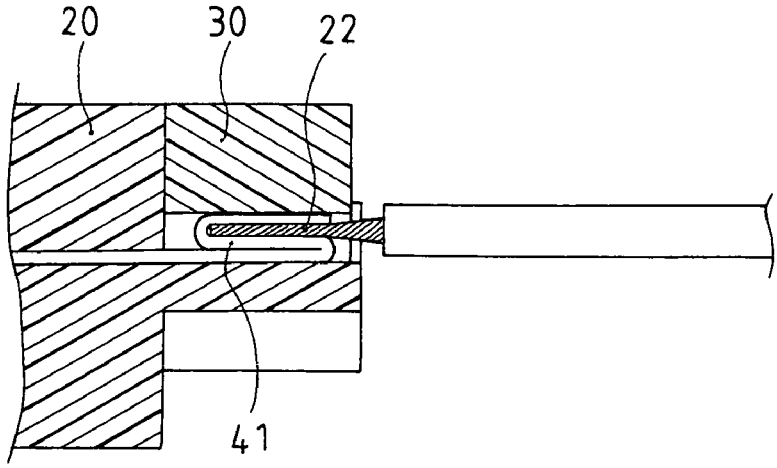

Referring to FIGS. 8 and 9 for another preferred embodiment of the metal contact bracket 41 of the present invention, the metal contact bracket 41 has an end substantially in the shape of "S" and bent upward with an appropriate angle of inclination for the second time. The flexible multi-core cable 22 is passed into the metal contact bracket 41 which is bent for the second time, such that the multi-core cable 22 is covered and clamped by the metal contact bracket 41, so as to enhance the close contact effect, the contact stability, and the quality of signal transmissions.

In summation of the above description, the present invention herein enhances the performance than the conventional structure and further complies with the patent application requirements and is submitted to the Patent and Trademark Office for review and granting of the commensurate patent rights.

While the invention has been described by means of specific embodiments, numerous modifications and variations could be made thereto by those skilled in the art without departing from the scope and spirit of the invention set forth in the claims.

What is claimed is:

1. An improved wire connecting terminal structure, comprising a plastic body, a plurality of metal contact brackets, a latching member and a multi-core cable; wherein:

said plurality of metal contact brackets are arranged evenly and integrally formed with said plastic body by plastic injection molding and having a planar surface, said planar surface of an end portion of each of said plurality of metal contact brackets being exposed from the rear section of said plastic body;

said plastic body having an upper groove and a lower groove disposed on both a left side and a right side of said plastic body;

said latching member having a pair of latch hooks respectively disposed on a left side and a right side of said latching member, said pair of latch hooks of said latching member being initially latched into said upper groove disposed on both left and right sides of said plastic body, and said latching member includes a plurality of containing grooves corresponding to said plurality of metal contact brackets for respectively receiving conductors of said multi-core cable to contact corresponding metal contact brackets in said containing grooves, said latching member being pressed downward and latched by said pair of latch hooks of said latching member being latched into said lower groove disposed on both left and right sides of said plastic body to press each of said conductors of said multi-core cable in close contact with said planar surface of said end portion of said corresponding metal contact bracket to form an overall wire connecting terminal.

2. The improved wire connecting terminal structure of claim 1, wherein said end portion of each said metal contact bracket is bent back and said planar surface extends upwardly at an angle of inclination to provide a bias force against a corresponding conductor of said multi-core cable when said latch hooks are respectively latched into said lower grooves, said angle of inclination being reduced responsive to said pressing by said latching member.

3. An improved wire connecting terminal structure comprising a plastic body, a metal contact bracket, a latching member and a multi-core wire; wherein:

a plurality of metal contact brackets are arranged evenly and integrally formed with said plastic body by plastic injection molding an end of each of said plurality of metal contact brackets being exposed from a rear section of said plastic body;

a two-sectional latch groove having an upper groove and a lower groove being disposed separately on both a left side and a right side of said plastic body;

said latching member having a pair of latch hooks respectively disposed on a left side and a right side of said latching member, and a plurality of containing grooves corresponding to said plurality of metal contact brackets said pair of latch hooks of said latching member being initially latched into said upper groove disposed on both left and right sides of said plastic body, and said latching member includes a plurality of containing grooves for separating said plurality of metal contact brackets one by one and passing a flexible multi-core cable onto said metal contact bracket in said containing groove and then said latching member being subsequently pressed and latched downward, so that said latch hook disposed on both left and right sides of said latching member is latched into said lower groove disposed on both left and right sides of said plastic body to keep said multi-core cable in a close contact with said metal contact bracket to form an overall wire connecting terminal, said metal contact bracket having an end being substantially S-shaped and bent upward twice with an angle of inclination.

* * * * *